United States Patent [19]

Steele et al.

[11] 4,098,340

[45] Jul. 4, 1978

[54] METHOD OF AND APPARATUS FOR CLEANING DOWN WELL VALVES OF WELL PUMPS IN SITU

[76] Inventors: Barney Raymond Steele, 804 Pacific; William E. Holiman, P.O. Box 66284, both of Houston, Tex. 77006

[21] Appl. No.: 814,885

[22] Filed: Jul. 12, 1977

[51] Int. Cl.[2] ..... E21B 37/00; E21B 43/00

[52] U.S. Cl. ..... 166/311; 166/68

[58] Field of Search ..... 166/311, 68, 68.5, 104; 417/430, 431 F; 254/31; 74/41

[56] References Cited

U.S. PATENT DOCUMENTS

| | | | |
|---|---|---|---|
| 2,874,641 | 2/1959 | McCandlish et al. | 166/68.5 |
| 2,911,921 | 11/1959 | Adams | 417/430 |
| 3,216,406 | 10/1965 | McDuffie | 166/88.5 |

*Primary Examiner*—James A. Leppink

*Attorney, Agent, or Firm*—Laurence R. Brown

[57] ABSTRACT

Pump valves are flushed by accelerated fluid flow therethrough induced by moving the pump rods through an accelerated downstroke.

13 Claims, 2 Drawing Figures

23
3
4
1
6
12
28
21
29
14
13
15
16
11
7
22
29
19
17
28
15
5
20
24
18
9
25
10
2
8
TO WELL 12
13
22
17
6
V2
B
A
C
26
27
30
24
25
V1
B
C
A
8

METHOD OF AND APPARATUS FOR CLEANING DOWN WELL VALVES OF WELL PUMPS IN SITU

This invention relates to cleaning of clogged well pump valves and more particularly it relates to cleaning of downhole well pump valves in situ.

BACKGROUND

Particularly with deep oil wells, a certain amount of sand and other debris is carried through the down-well valves, and may lodge in and disable the pumping action of the travelling valve mechanism manipulated by pump rods from a top side pumping mechanism. If the travelling valve does not close properly because of interspersed debris it cannot lift the fluids as the pumping mechanism lifts the rods.

Present practice is to withdraw the down-hole pump or valve assembly and rods with a hoist and derrick to clean the pump valve. This is time consuming, costly and requires expensive heavy duty equipment.

Well cleaning has been proposed by U.S. Pat. No. 1,075,261 by pumping down-hole through special pipes a fluid under pressure to break up or dislodge debris. However, this requires expensive pipe installation, and may not be compatible in deep wells or in oil wells having limited casing space, even if the expense were warranted.

OBJECTS

Accordingly it is a general object of this invention to provide improved method and apparatus for cleaning down-hole pump valves.

Another object of the invention is to clean the down-hole pump valves in situ.

A further object of the invention is to clean down-hole pump valves quickly at low cost.

BRIEF DESCRIPTION OF THE INVENTION

Thus, in accordance with the present invention, a low power portable auxiliary well cleaning pumping mechanism, preferably mounted on a truck bed, is attached to the pump rods of an existing well, with the normal top-side pumping mechanism disconnected. The auxiliary pumping mechanism is programmed to produce an accelerated downstroke on the pump rods which will force down-hole fluids through the down-hole valve mechanism at an accelerated rate tending to clean the travelling valve and dislodge debris thereby to permit the travelling valve to properly close and lift.

THE DRAWING

Other features, objectives and advantages of the invention will be found throughout the description and accompanying drawings, wherein:

FIG. 1 is a schematic sketch of a first auxiliary well pumping mechanism and associated control system embodiment provided by this invention, and FIG. 2 is a schematic sketch portion illustrating variations comprising a second embodiment of the invention.

DETAILED DESCRIPTION

Figure 1:
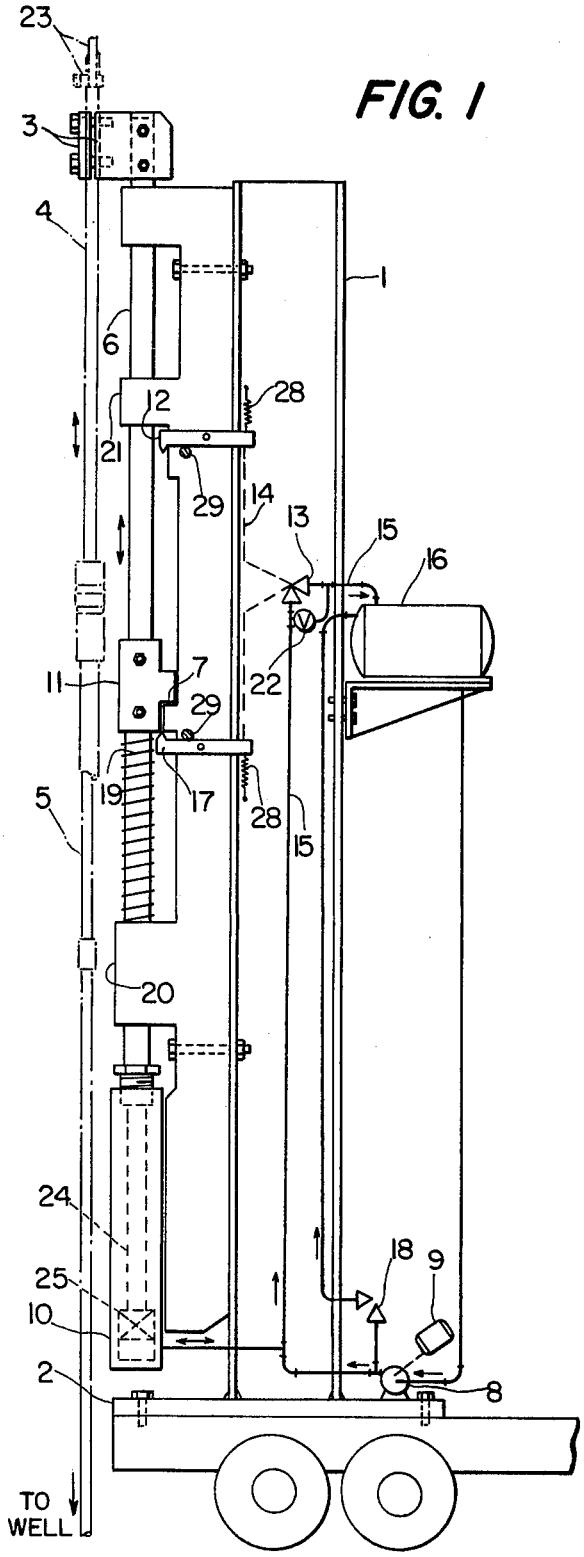

Now with reference to FIG. 1, a vertical I-beam 1 supports auxiliary pumping mechanism and extends from base plate 2, which is portably mounted on the bed of a truck (which preferably includes a stabilizing jack not shown) so that the entire assembly may be moved adjacent well pump rod string 5 for attachment of split slip clamp 3 to the polish rod 4. The hydraulic lift rod 6 by action of hydraulic cylinder 10 and its accompanying control system reciprocates clamp 3 over a range with control member 11 moving between lower mechanical stop 7 and an upper position determined by valve lever 12.

MOUNTING

To mount the auxiliary pumping mechanism, pressure is removed from the hydraulic cylinder 10 by means of manual by-pass fluid valve 22, so that control member 11 moves downwardly into contact with stop 7. Then the pump rod string 5 is lowered to the bottom of the pumping stroke by the top-side pumping mechanism (not shown) acting upon cable-clamp 23 at the top of polish rod 4. Then, slip clamp 3 is secured to polish rod 4. Control member 11 is adjustable on hydraulic lift rod 6 to conform with different pump string requirements and is adjusted so that stop 7 will support the weight of the rod system 5 just before the bottom of the pumping stroke is reached. Then cable clamp 23 is removed to disconnect the pump rod string from the top side well pumping mechanism and to transfer the entire pumping control to the auxiliary pumping mechanism.

CONTROL SYSTEM

The hydraulic system operates from fluid from hydraulic pump 8, driven by electric motor 9 and circulated through fluid surge tank 16 by way of hydraulic line routed to 16 and 10 (and connected to relief valve 18) and oil return piping 15. Hydraulic control systems for pumps are known and disclosed in U.S. Pat. Nos. 2,874,641 and 2,934,899 and may have different control circuits for achieving the purposes of this invention within the skills of those versed in the art. However the mode of operation is hereinafter discussed so that the relationship of the control circuits and auxiliary pump mechanism as afforded by this invention are understood. It is also to be understood that equivalent auxiliary pumping equipment could be used in the same manner as the hereinafter disclosed hydraulically controlled system.

In operation the fluid operating upon piston 25 of hydraulic cylinder 10, pushes the hydraulic lift rod end 24 to raise lift rod 6 through guides 20, 21 etc., and thus by way of clamp 3 to lift the pump rod string 5 over a pumping upstroke terminated when control member 11 engages upper valve lever 12. This valve lever 12, biassed by spring 28, by way of linkage 14 operates fluid release valve 13 which causes the pumped fluid to flow into pipes 15 bypassing cylinder 10. The valve 13 and pipes 15 are kept at low resistance to permit both fluid from pump 8 and from cylinder 10 to return rapidly to surge tank 16. The fluid pressure in cylinder 10 will be high due to the weight of the rod string 5 and will quickly discharge, letting the pump rod string 5 in essence fall by the force of gravity until control member 11 engages stop 7 for a rapid termination of the downstroke. This causes down well fluid to be passed through the travelling valve at a substantially higher rate of speed than ever encountered during the normal pumping operation or attainable with conventional cable and drum well servicing equipment and thus the accelerated flow of fluid therethrough will tend to dislodge and remove debris that would keep the valve from closing properly.

Typical oil well pumping rates are from 6 to 22 strokes per minute over stroke lengths of 1 to 2 feet (0.305 to 0.61 meters) with pump rod string motion rates in ft./min of 12 to 44 (3.66 to 13.42 m/min). With the method of this invention over a three feet (0.915 m) pump stroke fall with a 0.7 factor for resistance of the pump rod string, etc., under the force of gravity or speed of 90 ft/sec (27.45 M/S) is attained. Any down-stroke speed in the order of ten times normal pumping speed will materially aid the flushing action of down-hole fluids in accelerated flow through the valve mechanisms to dislodge debris.

After the down-stroke when control member 11 operates valve lever 17, which like 12 has a spring 28 and stop 29 to hold it in a datum position, and by means of the linkage reverses the position of fluid release valve 13 to close it and cause pump 8 once more to move the hydraulic piston 25 upwardly.

Since the downstroke is the work cycle, it is not necessary to move the pump fast upwardly, and thus quite modest, inexpensive pumping equipment may be employed. For example a ¼ HP, 12 volt d.c. motor is sufficient to operate a lift cylinder of 2 inch (5.08 cm) inner diameter and 36 inches (0.915 m) stroke on a vertical lift with a lift volume of 0.49 gal (1.85 l) and a hydraulic pump of 2000 psig (13780 KPa) output over a two minute upstroke. This assumes ⅝ inch pump (1.58 cm) rods at a depth no more than 6280 ft. (2967 m). In general two or three downstrokes will serve to clean out the valves. In practice however, as the valves are cleaned the downhole pump plunger will be required to lift the well's hydrostatic fluid column in addition to the rod weight and the power required for the hydraulic pump will be increased. However a number of cycles may be employed to cause the liquid pumped from the cleaned valves to be lifted from the well.

Spring 19 is used as a shock absorber because of the fast stop action. This fast stop is important in building up acceleration to a maximum along the entire length of stroke. Thus is the spring extends slightly above the stop 7 and rests on support member 20, the shock of contact between control member 11 and stop 7 will be substantially reduced.

Figure 2:
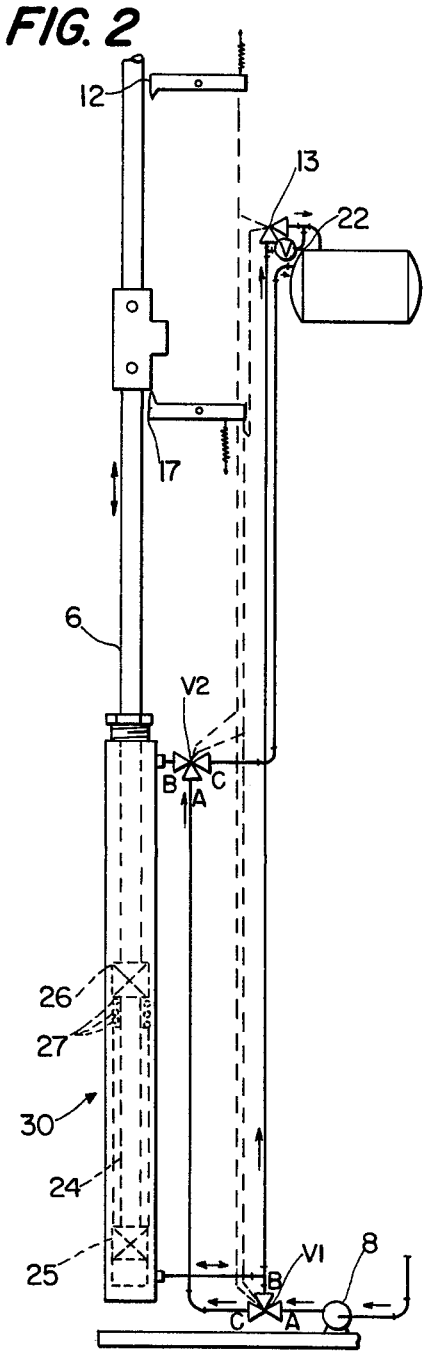

In some wells where downstroke resistance is higher and free fall by gravity is not feasible the version of FIG. 2 is preferred. This employs a double-acting hydraulic cylinder 30 so that the downward motion can be power assisted by the auxiliary pumping system. Three way valves $V_1$ and $V_2$ are employed with control levers 12, 17 causing the following conditions:

lowermost 13 closed; $V_1$ — A to B open, C closed; $V_2$ — B to C open, A closed, topmost 13 open; $V_1$ — A to C open, B closed; $V_2$ — A to B open, C closed.

In these condiions a higher powered hydraulic pump system may be desirable to produce the desired down-stroke speed and acceleration.

It is evident therefore that this invention has improved the state of the well valve cleaning art and that there are features of novelty defined with particularity in the appended claims believed descriptive of the nature and spirit of the invention.

What is claimed is:

1. The method of cleaning debris from down-well valves of well pumps having pump rods coupling the valves to a top-side pumping mechanism, comprising the steps of, connecting the pump rods to an alternative pumping mechanism for providing an accelerated down-stroke with a rod speed on downstroke of the order of at least ten times the downstroke rod speed effected by said top-side pumping mechanism, disconnecting the pump rods from the first said pumping mechanism, and forcing fluids at an accelerated rate through said down-well valves by operation of said alternative pumping mechanism through said accelerated down-stroke.

2. The method of claim 1 including the step of cyclically pumping said rods by said alternative pumping mechanism through a first slow rate of rod speed on lift and a second fast rate of rod movement on said accelerated down-stroke.

3. The method of claim 1 including the steps of mounting the alternative pumping mechanism on a mobile carrier, moving it adjacent the pump rods of a well in the field, and connecting it while mounted on said carrier.

4. The method of claim 1 including the step of stopping the down-stroke abruptly at the limit of the down-stroke.

5. The method of claim 1 wherein the accelerated down-stroke step is achieved by free-fall under the force of gravity.

6. The method of claim 1 wherein the accelerated down-stroke step is achieved by powering said alternative pumping mechanism to achieve a down-stroke speed of predetermined minimum magnitude under a normal down-stroke load of said pump rods with associated down-hole pumping mechanism.

7. Apparatus operational to clean debris from down-well valves of well pumps having pump rods coupling the valves to a top-side pumping mechanism by forcing fluids through said valves at an accelerated rate, comprising in combination, a portable pump mechanism having grasping means for connection to said pump rods to provide a stroke substantially the same distance normally provided by said top-side pumping mechanism, means powering said portable pump mechanism to lift said pump rods on a first slower stroke, means producing a second higher speed down-stroke of the order of a least ten times the speed of said top-side pumping mechanism on the down-stroke, and means programming the apparatus for cyclic pumping through said first and second strokes, thereby to force fluids through said valves at an accelerated rate thereby to dislodge debris.

8. Apparatus as defined in claim 7 wherein the means powering said portable pump mechanism comprises a reciprocating hydraulic cylinder system.

9. Apparatus as defined in claim 8 wherein the means producing the down-stroke comprises control means permitting the cylinder to exhaust without substantial resistance thereby to permit free fall of said pump rods under the force of gravity.

10. Apparatus as defined in claim 8 wherein the means producing the down-stroke comprises means providing hydraulic fluid power to said cylinder during the down-stroke to establish a predetermined speed of pump rod movement.

11. Apparatus as defined in claim 10 including upper and lower control means sensing the portable pump stroke limits, and a hydraulic system controlled therefrom including a pumping cylinder for reciprocating the stroke in response to the respective sensing means as each stroke limit is sensed.

12. Apparatus as defined in claim 11, wherein at least one of said upper and lower control means is positionable to change the stroke length.

13. Apparatus as defined in claim 1 wherein the hydraulic pump mechanism is of the order of less than 1 horsepower rating.

* * * * *